US005199425A

United States Patent [19]

Perrier

[11] Patent Number: 5,199,425

[45] Date of Patent: Apr. 6, 1993

[54] BREATHING APPARATUS WITH CHAMBER OF VARIABLE CAPACITY FOR SCUBA DIVING

[75] Inventor: Frédéric Perrier, Saint-Laurent-du-Var, France

[73] Assignee: La Spirotechnique Industrielle et Commerciale, Carros Cedex, France

[21] Appl. No.: 710,371

[22] Filed: May 22, 1991

[30] Foreign Application Priority Data

Jun. 7, 1990 [FR] France ..... 90 07076

[51] Int. Cl.[5] ..... A61M 16/00; A62B 7/04; A62B 9/02; F16K 31/26

[52] U.S. Cl. ..... 128/204.26; 128/205.24

[58] Field of Search ..... 128/204.26, 205.24, 128/204.28, 205.13–205.16, 204.29

[56] References Cited

U.S. PATENT DOCUMENTS 2,900,977 8/1959 Marsh ..... 128/204.26

FOREIGN PATENT DOCUMENTS 1228007 8/1960 France ..... 128/204.26

*Primary Examiner*—Edgar S. Burr
*Assistant Examiner*—Kimberly L. Asher
*Attorney, Agent, or Firm*—Young & Thompson

[57] ABSTRACT

A movable partition of a chamber of variable capacity consists of a diaphragm of elastomeric material which has been preshaped to provide a main part and a control part of reduced area, which is outwardly offset with respect to the main part and arranged for cooperating with a pressure reducer which selectively feeds a treating gas into the variable capacity chamber.

13 Claims, 1 Drawing Sheet

BREATHING APPARATUS WITH CHAMBER OF VARIABLE CAPACITY FOR SCUBA DIVING

BACKGROUND OF INVENTION (a) Field of the Invention

The present invention concerns breathing apparatuses for scuba diving of the closed or semi-closed circuit type comprising a chamber of variable capacity, which is partially delimited by means of a movable wall which is mounted on a housing through its periphery, the chamber of variable capacity permanently communicating with a portion of an inhaling circuit and a portion of an exhaling circuit and, selectively, with a source of a gas under pressure, through a pressure reducer which is mounted on the housing and which is controllable by cooperation with the movable wall.

(b) Description of Prior Art

In breathing apparatuses of this type, the movable wall of the variable capacity chamber, commonly called "breathing bag" or "false lung", is normally made of a cloth of coated fabric intentionally made sufficiently rigid to artificially "stiffen" during the inhaling and exhaling of gas under pressure. This is relatively important to the respiratory work of the diver, even when the pressure reducer is not acted upon. As a matter of fact, in this type of apparatus, as the diver breathes, the oxygen of the mixture of gas under pressure is consumed and transformed into carbon dioxide which is retained by means of a purifying cartridge. The gas thus consumed is replaced by the gas under pressure which is expanded at ambient pressure when the diver inhales and produces a sufficient depression in the variable capacity chamber so as to enable the movable wall to activate the pressure reducer. The flow of gas from this pressure reducer should be controlled by the diver so that he can introduce only the quantity of gas which is required for the good progress of his dive. If the flow from the pressure reducer is too substantial, the quantity of gas which is introduced into the variable capacity chamber will be too great and will modify the floatability of the diver and of his apparatus.

SUMMARY OF INVENTION

It is an object of the present invention to propose an arrangement which enables a diver to reduce his breathing effort while preserving a perfect control of the injection of the respiratory gas within the variable capacity chamber.

For this purpose, according to a characteristic of the invention, there is provided a movable wall which comprises a diaphragm of elastomeric material which is preshaped to provide a main part, which is relatively flexible, and a control part of reduced surface area, which is offset outside the housing with respect to the main part and arranged to cooperate with the pressure reducer.

According to another characteristic of the invention, the main part is connected to the periphery of the diaphragm by means of at least one fold outwardly projecting from the housing.

With such an arrangement, the main part of the diaphragm, which has a substantial surface area and which is relatively flexible, may easily be moved under the action of a weak variation of pressure in the variable capacity chamber, whenever it is not necessary to provide in the latter an injection of gas under pressure.

On the other hand, the control part, which has a reduced surface area and which is typically more rigid, will only be moved under the action of a resulting pressure variation in the variable capacity chamber. This pressure variation is produced by the diver by selectively and knowingly activating the pressure reducer.

This arrangement enables a diver to substantially reduce his respiratory operation, while the pressure reducer is not in operation. During the introduction of gas under pressure into the variable capacity chamber, the diver must produce a depression which is required for the movement of the control part of the diaphragm. This enables him to perfectly control the introduction of gas under pressure into the apparatus.

BRIEF DESCRIPTION OF DRAWINGS

Other characteristics and advantages of the present invention will appear from the description which follows of an embodiment given by way of illustration but without limitation, with reference to the annexed drawings, in which.

DESCRIPTION OF PREFERRED EMBODIMENTS

Figure 1:
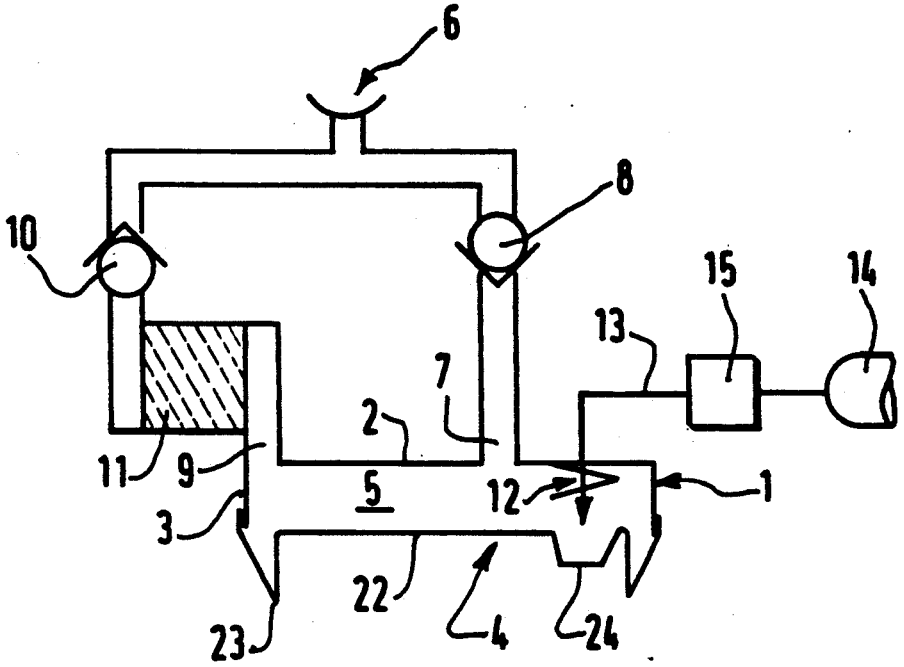
FIG. 1 is a schematic representation of a breathing apparatus for scuba diving according to the invention, of the closed circuit type.

In the description which follows and on the drawings, identical or analogous elements are referred to by the same reference numerals.

FIG. 1 shows a breathing apparatus for scuba diving with gas regeneration, of the closed type, comprising a housing 1, advantageously made of plastic or composite material, with a bottom 2 and a peripheral wall 3, which is closed by a movable wall 4 thus defining an internal variable capacity chamber 5. The latter is in permanent communication with a breathing mouth piece 6 through a portion of the inhaling circuit 7 provided with a check valve 8, and a portion of exhaling circuit 9 provided with a check valve 10 and a carbon dioxide purifying cartridge 11. The variable capacity chamber 5 selectively communicates, through a pressure reducer 12 mounted in the housing 1, with a duct 13 of breathing gas available under pressure from a bottle 14 through a high-pressure reducer 15 with manual control.

Figure 2:
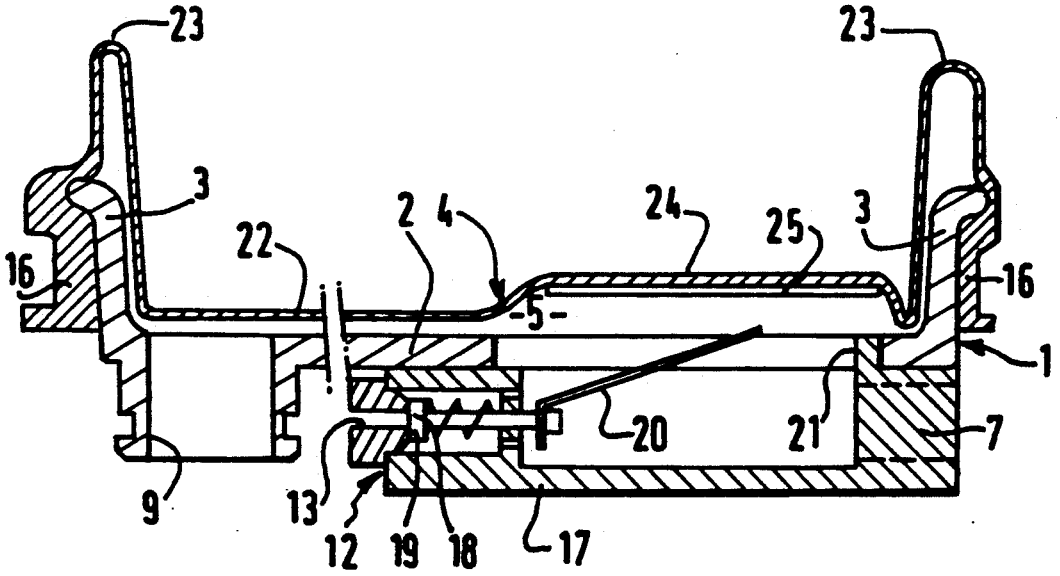
FIG. 2 is a view in partial cross-section of the variable capacity of the apparatus of FIG. 1.

As better illustrated in FIG. 2, the movable wall 4 consists of a diaphragm in the shape of a flexible membrane of elastomeric material, typically of silicone of Shore hardness between 30 and 40, a thickness between 1.5 and 3 mm, of annular shape, resiliently mounted by means of a peripheral bead 16 on the peripheral wall 3 of the housing 1. A pressure reducer housing 17 is mounted on the bottom 2 of the housing 1 and contains a valve 18 cooperating with a valve seat 19 in which duct 13 opens. Valve 18 may be operated in known manner by means of a rocking lever 20 slightly projecting into a cavity 21 at the bottom of the housing.

According to an aspect of the invention, the diaphragm 4 is shaped to provide a main part 22 of normally substantially flat configuration, connected to the peripheral bead 16 by means of an outwardly projecting peripheral fold 23, and a control part of reduced surface area 24 outwardly outset with respect to the main part 22 and disposed opposite the cavity 21 so as to be able to selectively cooperate with the lever 20 to activate the pressure reducer 18 when the breathable volume of the chamber 5 has reached its acceptable minimum (on the order of 0.1 liter).

Diaphragm 4 has a useful diameter larger than 0.10 m, typically about 0.25 m, and is dimensioned to present a maximum volume of the chamber 5 on the order of 6 liters. The surface area of the control part 24 is lower than one tenth of the surface area of the main part. In the example which is illustrated, the control part 24 is circular and has a useful diameter of about 45 mm. The internal face of the control part 24, cooperating with the lever 20, may be provided with a reinforcing coating 25.

Although the present invention has been described with respect to a specific embodiment, it is not limited thereby but, on the contrary, is susceptible of modifications and variants, which would appear to one skilled in the art.

We claim:

1. A breathing apparatus comprising a housing, a demand valve in the housing, said housing having an actuating member and connectable to a source of breathing gas under pressure that discharges into a variable capacity chamber delimited by a surface and a peripheral wall portion of the housing and outwardly by a flexible wall member mounted by its periphery on the peripheral wall portion of the housing, said flexible wall consisting of means for reducing the breathing effort of a diver and for improving the diver's control during a dive, said means comprising a diaphragm made out of an elastomeric material which has been preshaped to have a central portion with a main part and a control part of reduced area which is offset in an outward direction of the housing relative to the main part, said control part being located to cooperate with the actuating member when the diaphragm is fully depressed by the breathing effort of the diver.

2. The apparatus of claim 1, wherein the central portion of the diaphragm is connected to the peripheral wall portion of the housing by a connecting portion of the diaphragm forming at least one fold extending outwardly relative to the surface of the housing.

3. The apparatus of claim 2, wherein the control part is provided with a reinforcing coating on a face engaging with the actuating member.

4. The apparatus of claim 1, wherein the control part is substantially flat.

5. The apparatus of claim 4, wherein the area of the control part does not exceed one tenth the area of the main part.

6. The apparatus of claim 4, wherein the actuating member is partly received in a recess of the housing, said recess opening into the surface of the housing below the control part of the diaphragm.

7. The apparatus of claim 1, further comprising a breathing loop circuit including a mouth piece and communicating permanently with the chamber.

8. The apparatus of claim 7, wherein the breathing loop circuit includes a purifying cartridge.

9. The apparatus of claim 7, wherein the diaphragm is circular and has a diameter not less than 0.10 meter.

10. The apparatus of claim 9, wherein the diameter of the diaphragm is about 0.25 meter.

11. The apparatus of claim 1, wherein the diaphragm has a diameter between 0.10 and 0.25 meter.

12. A breathing apparatus comprising a housing, a demand valve in the housing, said housing having an actuating member and connectable to a source of breathing gas under pressure that discharges into a variable capacity chamber delimited by a surface and a peripheral wall portion of the housing and outwardly by a flexible wall member mounted by its periphery on the peripheral wall portion of the housing, said flexible wall consisting of a diaphragm made out of an elastomeric material, and which has been preshaped to have a central portion with a main part and a control part of reduced area which is offset in an outward direction of the housing relative to the main part, said control part being more rigid than the main part and being located to cooperate with the actuating member when the diaphragm is fully depressed by a breathing effort of a user.

13. In a breathing apparatus comprising a housing defining part of a breathing gas chamber and including a demand valve having an actuating member extending into the chamber, a flexible wall connectable to the housing to delimit the chamber, the improvement comprising said flexible wall consisting of a circular diaphragm made out of an elastomeric material, and being preshaped to have a peripheral mounting portion and a central portion with a main part and a substantially flat control part, said control part being offset in an outward direction of the housing from the main part, more rigid than the main part, and adapted to engage with the actuating member when the diaphragm is fully depressed by the breathing effort of a user.

* * * * *